US008161892B2

(12) United States Patent
Palese

(10) Patent No.: US 8,161,892 B2
(45) **Date of Patent: *Apr. 24, 2012**

(54) EXPANDABLE TABLE

(75) Inventor: Jeffrey W. Palese, Cleveland, OH (US)

(73) Assignee: Blue Sky Innovation Group, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/109,324

(22) Filed: May 17, 2011

(65) Prior Publication Data

US 2011/0239912 A1 Oct. 6, 2011

Related U.S. Application Data

(63) Continuation of application No. 13/077,032, filed on Mar. 31, 2011.

(60) Provisional application No. 61/320,107, filed on Apr. 1, 2010, provisional application No. 61/320,944, filed on Apr. 5, 2010, provisional application No. 61/324,140, filed on Apr. 14, 2010, provisional application No. 61/355,696, filed on Jun. 17, 2010.

(51) Int. Cl.
*A47B 37/00* (2006.01)

(52) U.S. Cl. ..... 108/50.01; 108/85; 135/16

(58) Field of Classification Search ..... 108/50.12, 108/83, 84, 85, 86, 87, 89; 135/16
See application file for complete search history.

(56) References Cited

U.S. PATENT DOCUMENTS

| | | | | | |
|---|---|---|---|---|---|
| 580,543 | A | * | 4/1897 | Bradford | 108/85 |
| 720,590 | A | | 2/1903 | Johnson | |
| 1,342,481 | A | * | 6/1920 | Wennerstrom | 108/86 |
| 1,358,353 | A | * | 11/1920 | Zimmer | 108/67 |
| 1,751,831 | A | * | 3/1930 | McNulty | 108/85 |
| 1,778,666 | A | | 10/1930 | Fox | |
| 1,861,565 | A | * | 6/1932 | Hall | 108/84 |
| 1,937,250 | A | | 11/1933 | Seng et al. | |
| 1,965,245 | A | * | 7/1934 | Lillard | 108/85 |
| 2,098,233 | A | * | 11/1937 | Giles | 108/85 |
| 2,591,066 | A | * | 4/1952 | Hartman | 108/85 |
| 3,033,629 | A | | 5/1962 | Riendeau | |
| 4,061,091 | A | * | 12/1977 | Goyvaerts | 108/84 |
| 4,475,464 | A | | 10/1984 | Deconinck | |
| 4,494,466 | A | | 1/1985 | Synek et al. | |
| D286,592 | S | | 11/1986 | Deconinck | |
| 4,815,393 | A | | 3/1989 | Pollak | |
| 4,878,439 | A | | 11/1989 | Samson | |
| D326,025 | S | | 5/1992 | Grosfillex | |

(Continued)

FOREIGN PATENT DOCUMENTS

| | | |
|---|---|---|
| EP | 0 187 922 | 7/1986 |

(Continued)

*Primary Examiner* — Jose V Chen

(74) *Attorney, Agent, or Firm* — Fay Sharpe LLP; Brian E. Turung

(57) ABSTRACT

An expandable table that has a frame, at least one leg supporting the frame, first and second top portions movably connected or interconnected to the frame, an intermediate top portion movably connected or interconnected to the frame, and a movement mechanism connected or interconnected to the frame. The movement mechanism is configured to cause the first and second top portions to move along a longitudinal axis of the frame. The movement mechanism is also configured to cause the intermediate top portion to move normal to said longitudinal axis of a plane of movement of said first and second top portions.

14 Claims, 14 Drawing Sheets

U.S. PATENT DOCUMENTS

| | | | | |
|---|---|---|---|---|
| 5,335,803 | A * | 8/1994 | O'Brien et al. | 108/50.12 |
| 5,735,220 | A | 4/1998 | Wang | |
| 6,443,074 | B1 | 9/2002 | Adams | |
| 6,463,946 | B1 * | 10/2002 | Wu | 108/50.12 |
| 6,629,504 | B2 | 10/2003 | Stem | |
| 6,666,151 | B2 | 12/2003 | Adams | |
| 6,698,363 | B2 | 3/2004 | Mallon | |
| 6,715,429 | B2 | 4/2004 | Adams | |
| 6,729,243 | B2 | 5/2004 | Annas | |
| 6,742,461 | B1 | 6/2004 | Sen | |
| 7,201,108 | B2 | 4/2007 | Eusebi et al. | |
| 7,201,461 | B2 | 4/2007 | Kim | |
| 2007/0012226 | A1 * | 1/2007 | Chen | 108/86 |
| 2011/0239911 | A1 * | 10/2011 | Palese | 108/85 |

FOREIGN PATENT DOCUMENTS

| | | |
|---|---|---|
| EP | 1 371 305 | 6/2003 |
| JP | 06-197814 | 7/1994 |

* cited by examiner

EXPANDABLE TABLE

The present invention is a continuation of U.S. patent application Ser. No. 13/077,032 filed Mar. 31, 2011, which in turn claims priority on U.S. Provisional Application Ser. Nos. 61/320,107 filed Apr. 1, 2010; 61/320,944 filed Apr. 5, 2010; 61/324,140 filed Apr. 14, 2010; and 61/355,696 filed Jun. 17, 2010, all of which are incorporated herein by reference.

The present invention is directed to furniture, and more particularly to tables that can be expanded in length, and even more particularly to expandable patio and/or dining furniture. Although the present invention is particularly directed to tables, it can be appreciated that the invention can be used in additional applications (e.g., expandable platforms, expandable counter tops, expandable desks, expandable beds, expandable trays, expandable carts, etc.).

BACKGROUND OF THE INVENTION

Expandable tables are well known in the art. Examples of such tables are disclosed in U.S. Pat. Nos. 7,201,108; 6,742,461; 6,729,243; 6,715,429; 6,698,363; 6,666,151; 6,629,504; 6,443,074; 5,735,220; 4,878,439; 4,815,393; 4,494,466; 4,475,464; 3,033,629; 1,937,250; 1,778,666; 720,590; Des. 326,025; Des. 286,592; and EP 1 371 305 and EP 0 187 922 and JP 06-197814, all of which are incorporated herein by reference.

Prior configurations of expandable tables required the table leaves to be inserted at the ends of the table and/or between two separated portions of the table. The table leaves were generally stored at some location remote to the table or were folded under or stored under table top. As such, the leaf has to be moved and/or lifted by a user when inserting and removing the leaf in the table. Such moving and lifting can be inconvenient and difficult for many users. Many types of patio tables include an umbrella opening for receiving the umbrella pole. When a leaf is inserted or removed from such types of tables, the umbrella must be removed from the table and then reinserted in the table. The removal and reinsertion of the umbrella can be very inconvenient and difficult for many users.

In view of the current state of expandable tables, there is a need for an expandable table that makes it simple to expand and contract the table. For expandable tables that are used with umbrellas, there is a need for an expandable table that can be expanded and contracted without having to remove the umbrella.

SUMMARY OF THE INVENTION

The present invention is directed to tables that can be expanded in length, and even more particularly to expandable patio and/or dining furniture. The table of the present invention includes a frame, one or more legs, a first top portion, a second top portion and an intermediate top portion. The first and second top portions are designed to be movable on the frame. The intermediate top portion is designed to be positioned between the first and second top portions when the table is in the expanded position. The number of legs used to support the frame is non-limiting. The shape and size of the frame, legs, first and second top portions and intermediate top portion are non-limiting. The materials used to form the table are non-limiting. The first and second top portions both have an inner edge wherein the inner edges are positioned next to or closely adjacent to one another when the table is in the unexpanded position. The intermediate top portion has two outer edges that are positioned next to or closely adjacent to the inner edges of the first and second top portions when the table is in the expanded position. At least one of the first and second top portions, and typically both the first and second top portions, are designed to move toward and away from one another along the longitudinal axis of the frame when the first and second top portions are moved between the expanded and unexpanded positions. The intermediate top portion is designed to move upwardly and downwardly or in a plane that is normal to the longitudinal axis of the frame. When the first and second top portions are moved apart a sufficient distance, the intermediate top portion can be raised to form part of the top surface of the table. Generally, the intermediate top portion is raised so that the top surface of the intermediate top portion lies in the same or substantially the same plane as the plane of the top surfaces of the first and second top portions; however, this is not required. Once the intermediate top portion is raised from its stowed position, the first and/or second top portions can be moved toward the raised intermediate top portion until the two outer edges of the intermediate top portion are positioned next to or closely adjacent to the inner edges of the first and second top portions. When the table is to be reconfigured to the unexpanded position, the intermediate top portion is moved downwardly to the stowed position and the first and/or second top portions are moved together until the inner edges of the first and second top portions are positioned next to or closely adjacent to one another. When the table is in the unexpanded position, the intermediate top portion is positioned and stowed below the first and second top portions. This novel configuration and arrangement for the intermediate top portion enables the intermediate top portion to be moved upwardly and downwardly when configuring the table between the expanded and unexpanded positions. Generally, the intermediate top portion is connected or interconnected to the frame to enable the intermediate top portion to be moved upwardly. and downwardly. Generally, the intermediate top portion is designed to not be removed from the frame configuring the table between the expanded and unexpanded positions; however, this is not required.

In another non-limiting aspect of the invention, the frame of the table includes a movement mechanism that enables the first and second top portions to move (e.g., slide mechanism, roller mechanism, ball bearing mechanism, etc.) relative to the top of the frame. Various types of railing systems can be used to enable such movement of the first and second top portions relative to the frame. In one non-limiting embodiment of the invention, the movement mechanism does not include ball bearings; however, this is not required. In another and/or alternative non-limiting embodiment of the invention, the movement mechanism includes a rail system that allows rail sections to slide or move relative to one another without the use of ball bearings; however, this is not required. In still another and/or alternative non-limiting embodiment of the invention, the movement mechanism includes multiple rail systems; however, this is not required. In yet another and/or alternative non-limiting embodiment of the invention, the movement mechanism is designed to simultaneously cause both the first and second top portions to move together when the first and second top portions are moved between the expanded and unexpanded positions; however, this is not required. In one non-limiting design, the movement mechanism is designed to simultaneously cause both the first and second top portions to move together in opposite directions and in substantially the same amounts and at the same speed when the first and second top portions are moved between the expanded and unexpanded positions; however, this is not required. In such an arrangement, the first and second top portions move a similar distance away from one another when the first and second top portions are moved to the full expanded position and move a similar distance toward one another when the first and second top portions are moved to the full unexpanded position. Many different arrangements can be used to cause the movement of both the first and second top portions when such top portions are moved between the expanded and unexpanded positions.

In still another non-limiting aspect of the invention, the frame of the table includes a movement mechanism that enables the intermediate top portion to move upwardly to a full upward position and downward to the stowed position as the first and second top portions are moved between the expanded and unexpanded positions; however, this is not required. In one non-limiting embodiment of the invention, the movement mechanism allows for manual lifting and/or lowering of the intermediate top portion when the first and second top portions are moved to a certain position; however, this is not required. In one non-limiting arrangement, the intermediate top portion is connected or interconnected to the frame so that it cannot be completely lifted off or removed from the frame when the intermediate top portion is being raised and/or lowered; however, this is not required. In another and/or alternative non-limiting embodiment of the invention, the movement mechanism causes automatic lifting and/or lowering of the intermediate top portion when the first and second top portions are moved to a certain position; however, this is not required. In such an arrangement, the movement mechanism can cause the intermediate top portion to move upwardly from the lower or stowed position when the first and second top portions are a sufficient distance away from one another (i.e. toward the expanded position); however, this is not required. Many different arrangements can be used to cause the intermediate top portion to automatically move upwardly and/or downwardly (e.g., rail and slot arrangement, spring system, electric motor, gear arrangement, weight and/or pulley arrangement, etc.). Once the intermediate top portion has moved upwardly, the first and second top portions can be designed to be moved slightly toward one another until the outer edges of the intermediate top portion are positioned next to or closely adjacent to the inner edges of the first and second top portions when the table is in the expanded position so as to form the expandable table in the expanded orientation; however, this is not required. Furthermore, when the expandable table is to be positioned from the expanded positioned to the smaller or unexpanded position, the movement mechanism can be designed such that when the first and second top portions are slightly moved apart from one another, the intermediate top portion is caused to move downwardly thereby enabling the first and second top portions to move together until inner edges of the first and second top portions are positioned next to or closely adjacent to one another; however, this is not required. The design of the automatic lifting and/or lowering of the intermediate top portion by the movement mechanism simplifies the movement of the intermediate top portion when the table is configured between the expanded and unexpanded orientations.

In still yet another non-limiting aspect of the invention, the table is designed to enable an umbrella to be used with the table. In one non-limiting embodiment of the invention, the first and second top portions include a cut-out portion or recessed portion that forms an opening for an umbrella pole when the inner edges of the first and second top portions are positioned next to or closely adjacent to one another. The cut-out or recessed portions on the first and second top portions are generally aligned with one another so as to form the umbrella pole opening when the inner edges of the first and second top portions are positioned next to or closely adjacent to one another. In another and/or alternative non-limiting embodiment of the invention, the intermediate top portion includes an umbrella opening designed to enable an umbrella pole to pass therethrough. In one non-limiting arrangement, the umbrella does not need to be removed from the expandable table when the expandable table is reconfigured between the expanded and unexpanded orientations. This feature is a significant advantage over prior art tables wherein the umbrella needed to be partially or fully removed from the table when the table was reconfigured between the expanded and unexpanded orientations. The expandable table of the present invention can be designed so that the intermediate top portion moves up and down when the expandable table is reconfigured between the expanded and unexpanded orientations. As such, the intermediate top portion is designed to slide up and down a portion of the umbrella pole when the table was reconfigured between the expanded and unexpanded orientations, thus eliminating the need for the umbrella to be removed from the expandable table when the expandable table is reconfigured between the expanded and unexpanded orientations.

In another non-limiting aspect of the invention, the first and/or second top portions can include engagement members (e.g., protruding flanges or legs, etc.) that engage another top portion so as to temporarily secure together, rigidify, stabilize, etc. the top of the expandable table; however, this is not required.

In still another non-limiting aspect of the invention, the configuration of the expandable table is non-limiting. The top portions of the table can form a top surface of the expandable table that has generally circular configurations, oval configurations, square configurations, rectangular configurations, etc. The pattern used to form one or more of the top portions of the expandable table is non-limiting. For example, one or more of the top portions can include a solid surface, a slatted surface, a glass surface, a plastic surface, a metal surface, a cross-hatch surface, etc. The expandable table can be made of many types of materials (e.g., metal, wood, glass, ceramic, stone, bamboo, plastic, etc.). As can be appreciated, the expandable table can be made of more than one type of material. The length, width and/or height of the expandable table are non-limiting. The color of the expandable table is non-limiting.

It is one non-limiting object of the present invention to provide an expandable table that is simple to use.

It is another and/or alternative non-limiting object of the present invention to provide an expandable table that can be reconfigured between the expanded and unexpanded orientations without having to remove and insert an intermediate top portion.

It is still another and/or alternative non-limiting object of the present invention to provide an expandable table that includes an intermediate top portion that is connected or interconnected to the table frame and which moves upwardly and downwardly and moves little, if any, within the longitudinal axis of the table frame when the expandable table is reconfigured between the expanded and unexpanded orientations.

It is yet another and/or alternative non-limiting object of the present invention to provide an expandable table that can be reconfigured between the expanded and unexpanded orientations without having to remove an umbrella pole.

It is another and/or alternative non-limiting object of the present invention to provide an expandable table that causes the intermediate top portion to automatically move between the downward or stowed position and the upward position when the expandable table is reconfigured between the expanded and unexpanded orientations.

These and other objects and advantages will become apparent from the following description taken together with the accompanying drawings.

BRIEF DESCRIPTION OF DRAWINGS

Reference may now be made to the drawings, which illustrate various embodiments that the invention may take in physical form and in certain parts and arrangements of parts wherein.

NON-LIMITING DETAILED DESCRIPTION OF THE INVENTION

Figure 1:
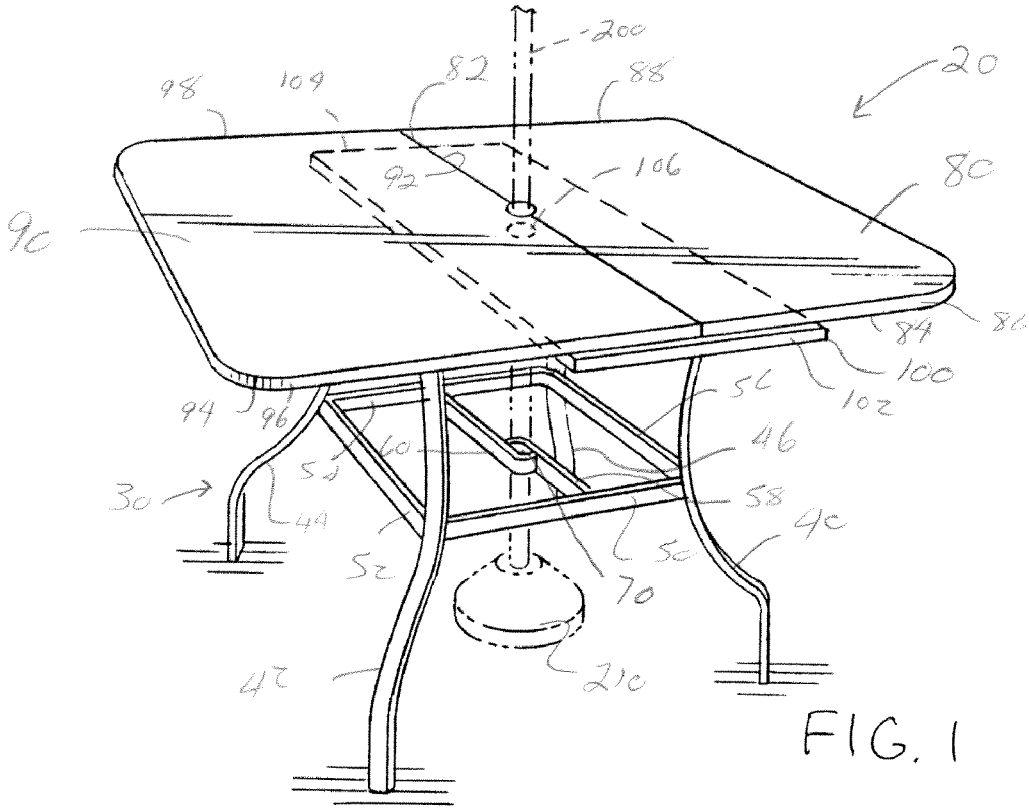
FIG. 1 is a front elevation view of the expandable table of the present invention in an unexpanded state.

Referring now to the drawings wherein the showings are for the purpose of illustrating non-limiting embodiments of the invention only and not for the purpose of limiting same, FIGS. 1-13 illustrate one-limiting embodiment of the expandable table of the present invention. The expandable table is illustrated as having a generally square shape for the top surface when the expandable table is in the unexpanded position. As can be appreciated, the shape of the top surface of the table can have many other configurations when in the unexpanded position (e.g., circular, oval, rectangular, etc.). The top surface of the table is illustrated as being solid; however, it can be appreciated that other configurations can be used (e.g., clear top, slatted top, cross-hatched top, etc.). The table can be made of one or more materials (e.g., metal, glass, plastic, ceramic, wood, rubber, composite materials, stone, bamboo, etc.). As can be appreciated, the expandable table can be made of more than one type of material. The length, width and/or height of the expandable table are non-limiting. The color of the expandable table is non-limiting.

Figure 6:
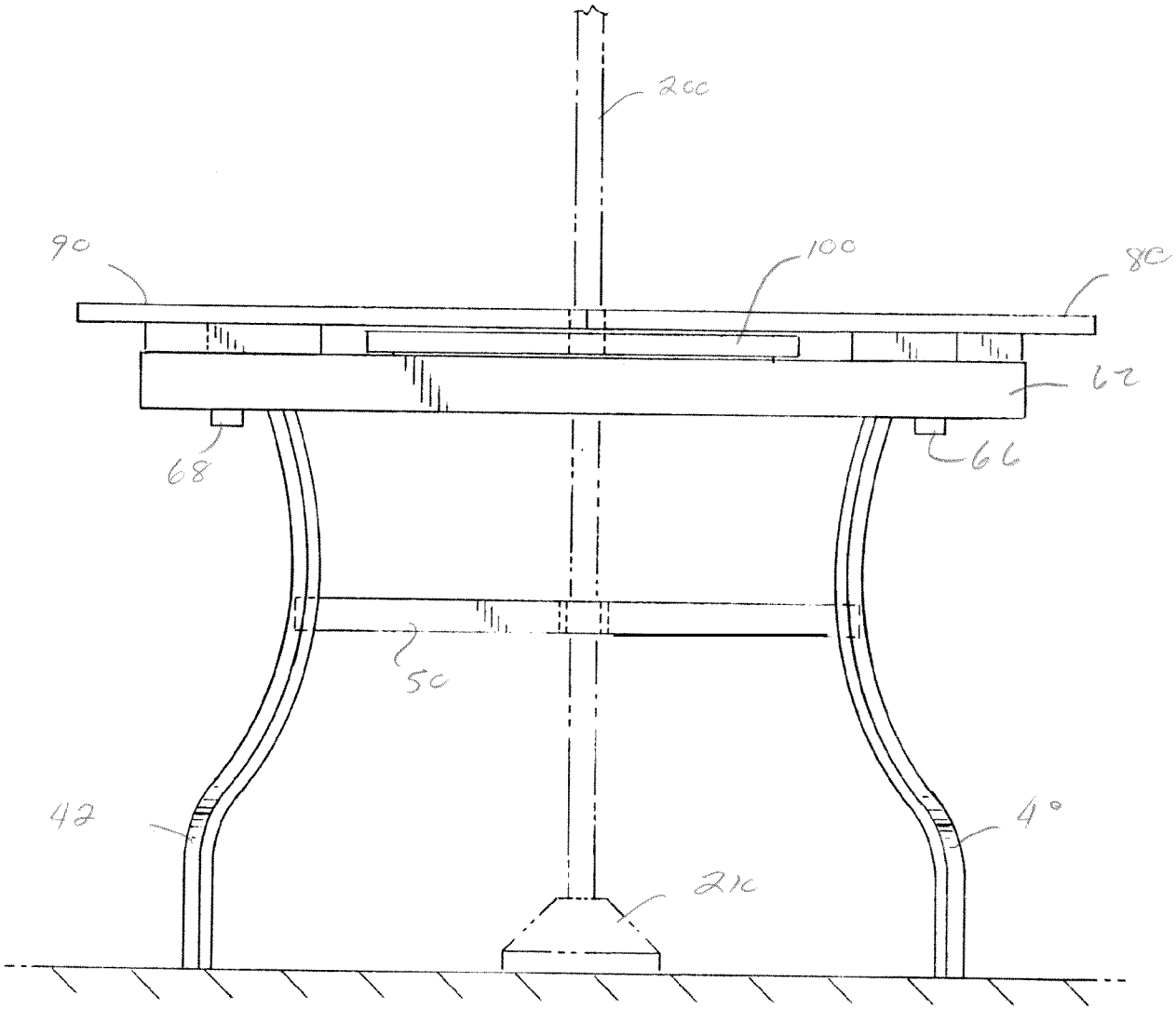
FIG. 6 is a side view of the expandable table in the unexpanded position.

The table 20 includes a frame 30. The configuration of the frame is non-limiting. The frame is illustrated as having four legs 40, 42, 44, 46. As can be appreciated, the frame can include a single leg, two legs, three legs, or more than four legs. Reinforcing structures 50, 52, 54, 56, 58, 60 can be optionally used to connect to one or more of the legs to rigidify the frame; however, this is not required. The configuration of the one or more reinforcing structures is non-limiting. As illustrated in FIG. 1, reinforcing structures 58, 60 are connected together to form an umbrella pole support opening 70. The formation of umbrella pole support opening is optional. The top of the legs are connected to the upper portion of the frame so as to rigidify the frame. As illustrated in FIG. 6, the upper portion of the frame includes two main side members 62, 64 and two connector bars 66, 68.

The expandable table is positioned in the unexpanded portion as illustrated in FIG. 1. The top of the expandable table is formed of first and second top portions 80, 90. An intermediate top portion 100 is illustrated as being positioned between the first and second top portions. As illustrated in FIG. 1, the inner side edges 82, 92 of the first and second top portions are positioned next to or closely adjacent to one another. As can be appreciated, the inner side edges can contact one another when the table is in the unexpanded position; however, this is not required. The intermediate top portion is positioned beneath the lower edge 84, 94 of the first and second top portions. The intermediate top portion is illustrated as having the same or similar length as the width of the first and second top portions; however, this is not required. Generally, the length of the intermediate portion is selected so that the front and back edges 102, 104 do not extend beyond the front edges 86, 96 and back edges 88, 98 of the first and second top portions; however, this is not required. The intermediate top portion is illustrated in the lower or stowed position in FIG. 1.

The expandable table can optionally be designed to be used with an umbrella. As illustrated in FIG. 1 there is illustrated an umbrella pole 200 in dotted lines. The base of the umbrella pole is positioned in an umbrella stand 210, also in dotted lines. The umbrella pole is illustrated as being inserted through the umbrella pole support opening 70 formed by support structures 58, 60. The umbrella pole also extends through umbrella opening 106 in the intermediate top portion. The inner side edges 82, 92 of the first and second top portions include an umbrella recess 89, 99. When first and second top portions are positioned in the unexpanded position, the two umbrella recesses 89, 99 align with one another and form an opening that the umbrella pole can extend therethrough as illustrated in FIG. 1. The size and shape of recesses 89 and 99 are generally the same. When the recesses are semi-circular, each recess is configured to encircle 40-60% of the outer perimeter of the umbrella pole; however, this is not required. As can he appreciated, when the expandable table is not designed to be used with an umbrella, the umbrella opening 106 in the intermediate top portion and umbrella recesses 89, 99 can be eliminated.

Figure 2:
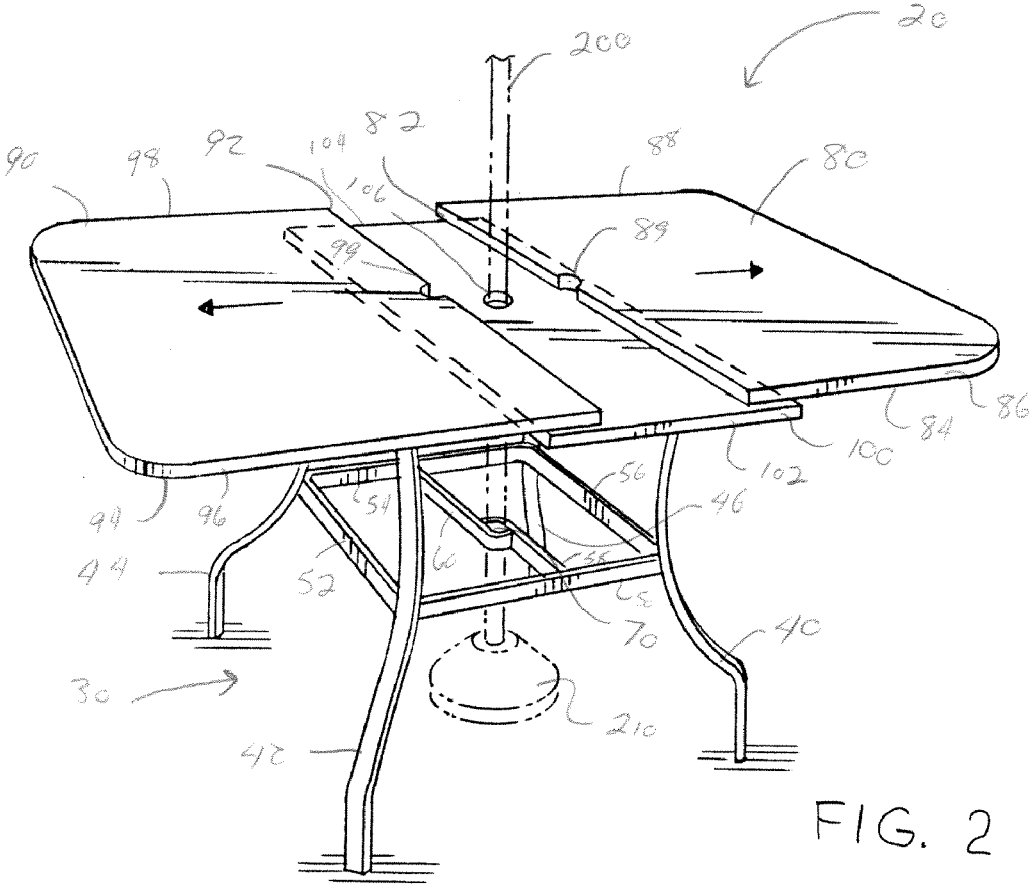
FIG. 2 is a front elevation view of he expandable table in the partially expanded position.

Referring now to FIG. 2, the first and second top portions are moved in the direction indicated by the arrows to thereby begin separating the first and second top portions so that the expandable table can be configured in the expanded position. As illustrated in FIG. 2, the intermediate portion remains in the lower or stowed position when the first and second top portions are initially moved apart from one another. As is also illustrated in FIG. 2, the umbrella pole, when used, remains inserted in the expandable table as the expandable table is converted from the unexpanded to the expanded position. As will be described in more detail below, when the table is designed for use with an umbrella, the unique configuration and operation of the expandable table enables the expandable table to be moved between the expanded and unexpanded configurations without having to remove the umbrella pole.

Figure 3:
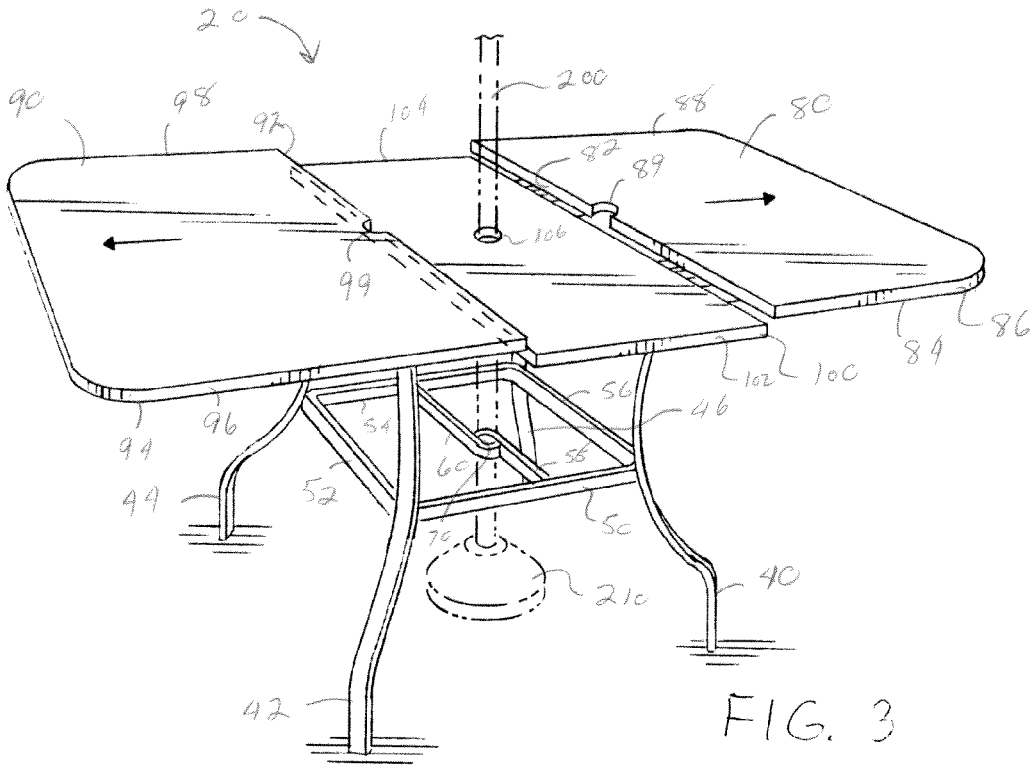
FIG. 3 is a front elevation view of the expandable table in the partially expanded position.

Referring now to FIG. 3, the first and second top portions have been moved apart a distance that is generally equal to the width of the intermediate portion. The top intermediate portion is illustrated as still being in the lower or stowed position.

Figure 4:
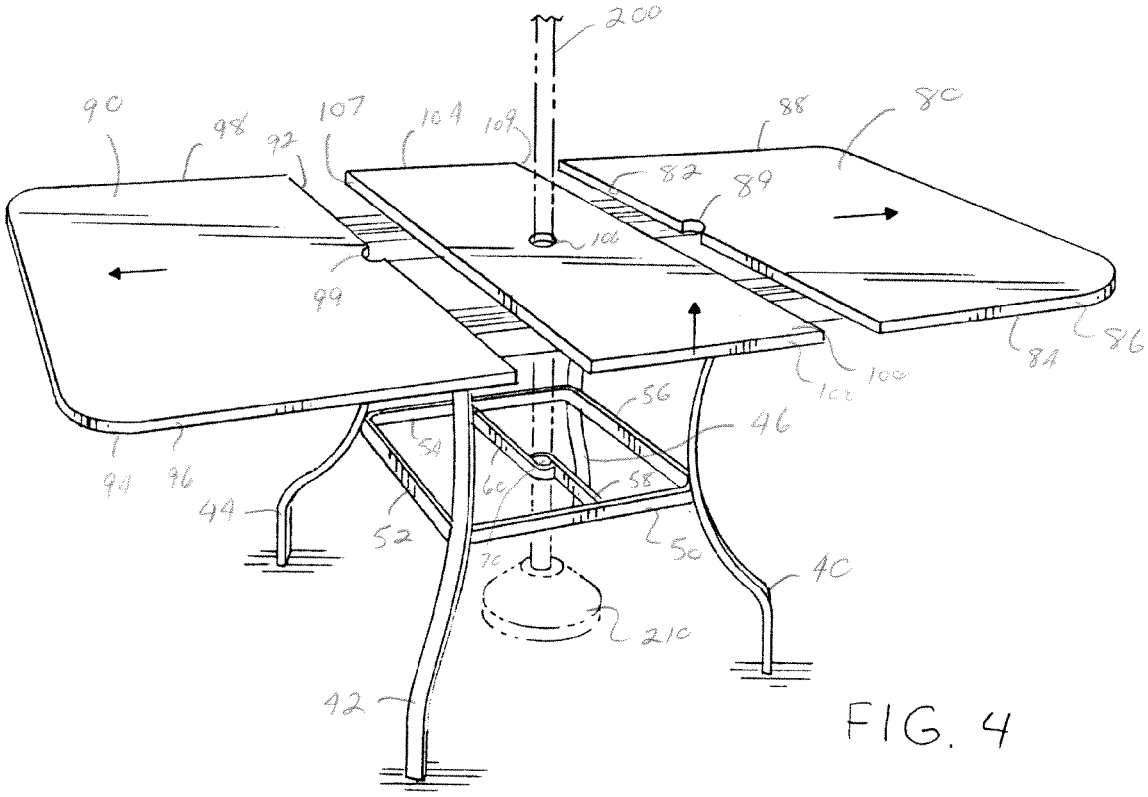
FIG. 4 is a front elevation view of the expandable table wherein the first and second top portions are in the fully expanded position and the intermediate portion has moved to an upper position.

Referring now to FIG. 4, the first and second top portions are illustrated as being moved to the fully extended positions. In such positions, the first and second top portions have been moved apart a distance that is greater than the width of the intermediate portion. The top intermediate portion is illustrated as now being in the upper position as indicated by the arrow. In the upper position, the top surface of the intermediate top portion lies in the same or substantially the same plane and the top of the first and second top portions. The movement of the intermediate top portion from the lower position to the upper position occurs in a plane that is normal or substantially normal to the plane of movement of the first and second top portions. The novel movement of the intermediate top portion enables the umbrella pole, when used, to remain positioned in the expandable table as the expanded table is configured between the expanded and unexpanded configurations.

Figure 5:
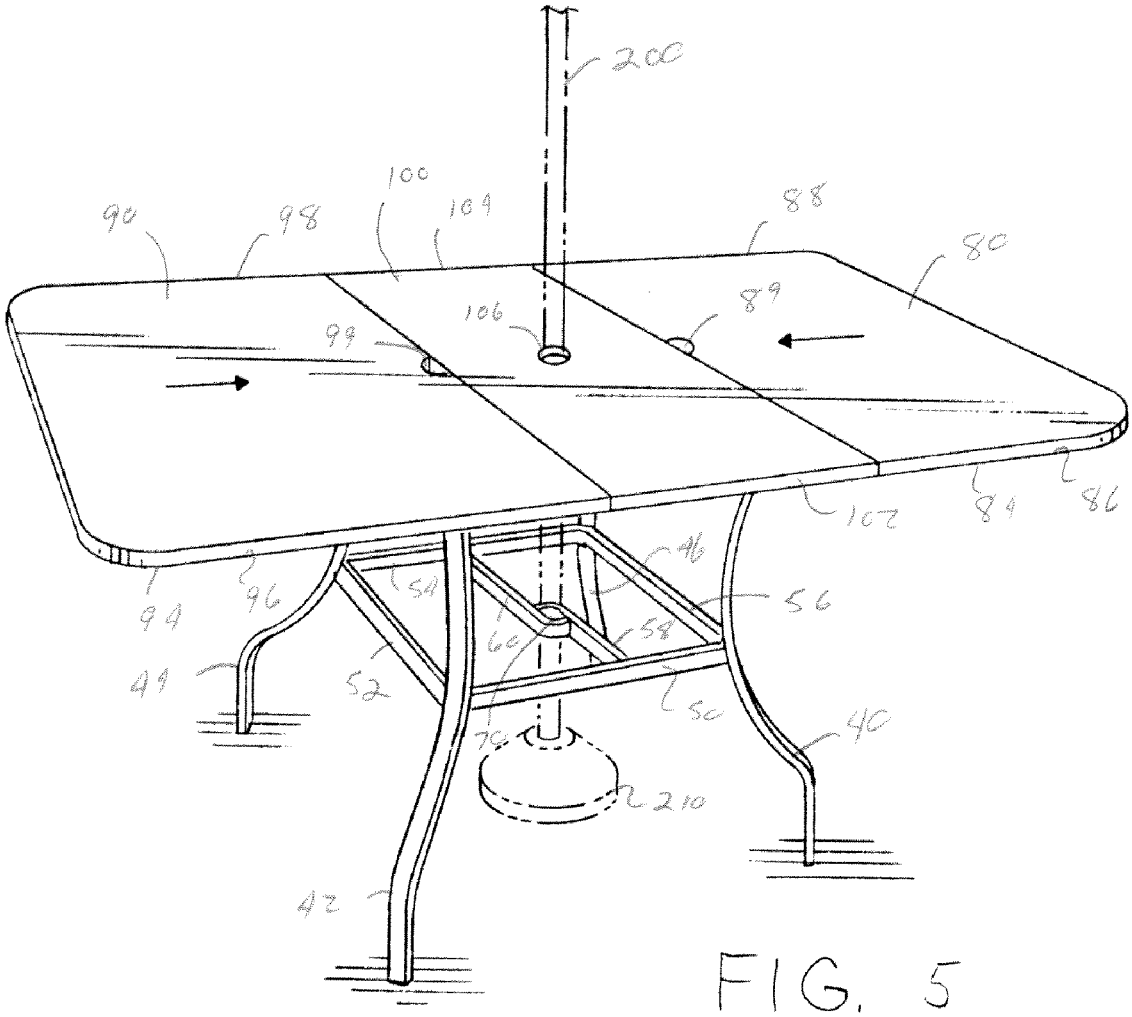
FIG. 5 is a front elevation view of the expandable table in the expanded position.

Once the intermediate top portion is moved to the upper position, the first and second top portions are moved together as indicated by the arrows in FIG. 5 until inner side edges 82, 92 of the first and second top portions engage or are more closely adjacent to side edges 107, 109 of the intermediate top portion. FIG. 5 illustrates the expandable table in the expanded configuration.

Figure 7:
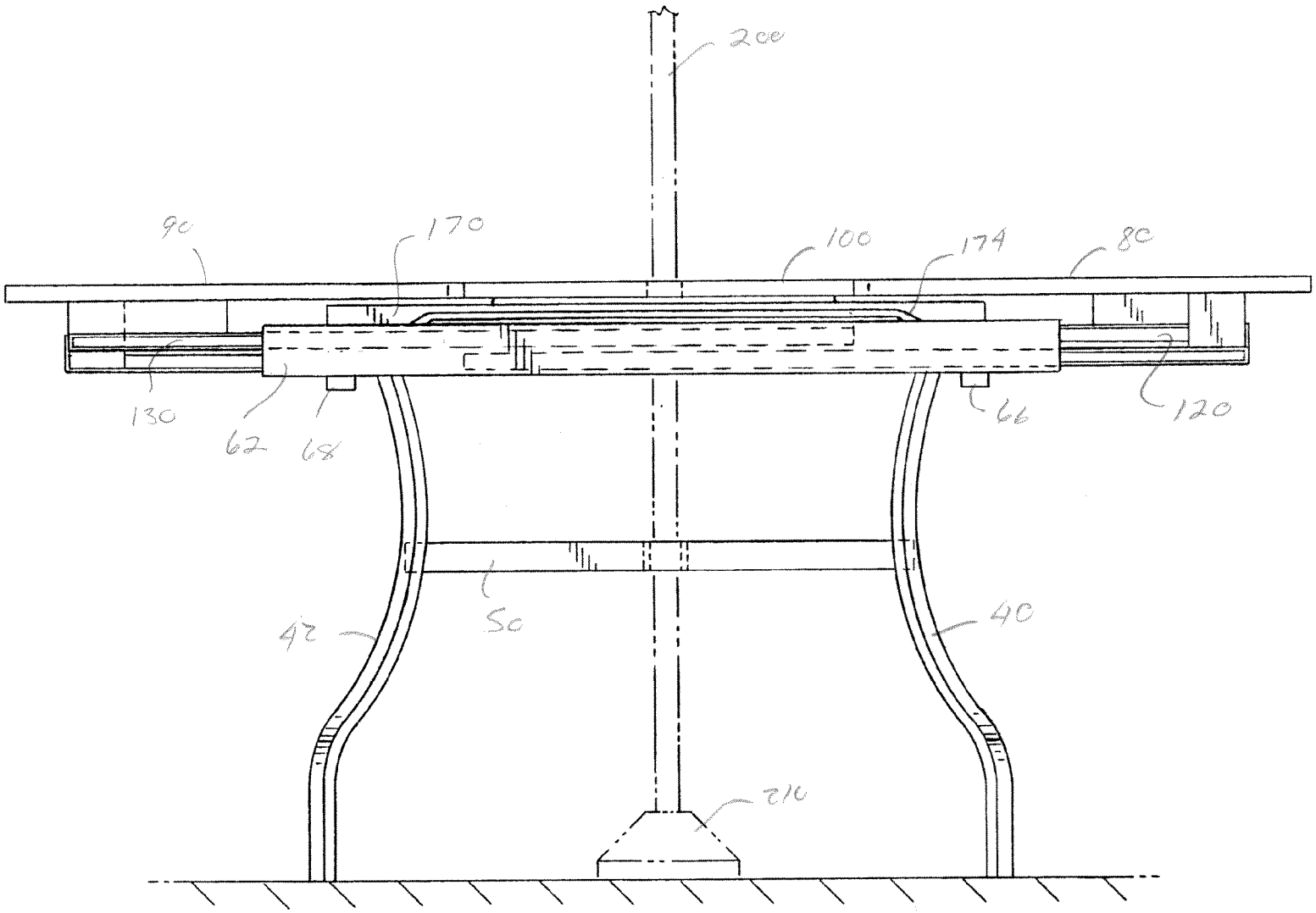
FIG. 7 is a side view of the expandable table in the expanded position.

Referring now to FIGS. 6-13, one non-limiting arrangement that can be used to move the first, second and intermediate top portions on the frame of the expandable table is illustrated. As can be appreciated, other arrangements can be used to move the first, second and/or intermediate top portions on the frame of the expandable table. FIG. 6 illustrates a side view of the expandable table in the unexpanded position. FIG. 7 illustrates a side view of the expandable table in the expanded position.

Figure 8:
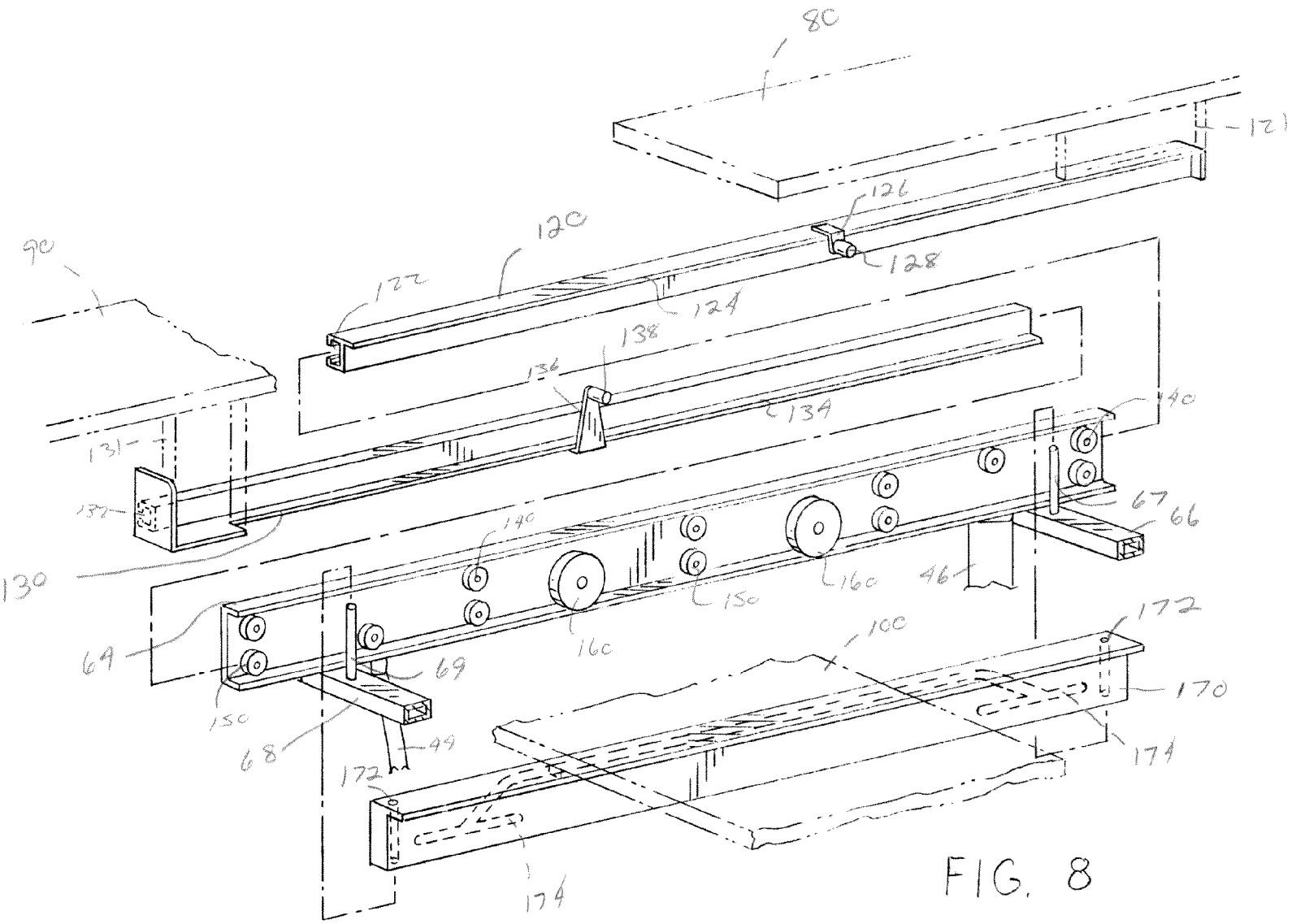
FIG. 8 is an exploded view of one non-limiting rail system configuration for movement of the first and second top portions used on the expandable table.
Figure 9:
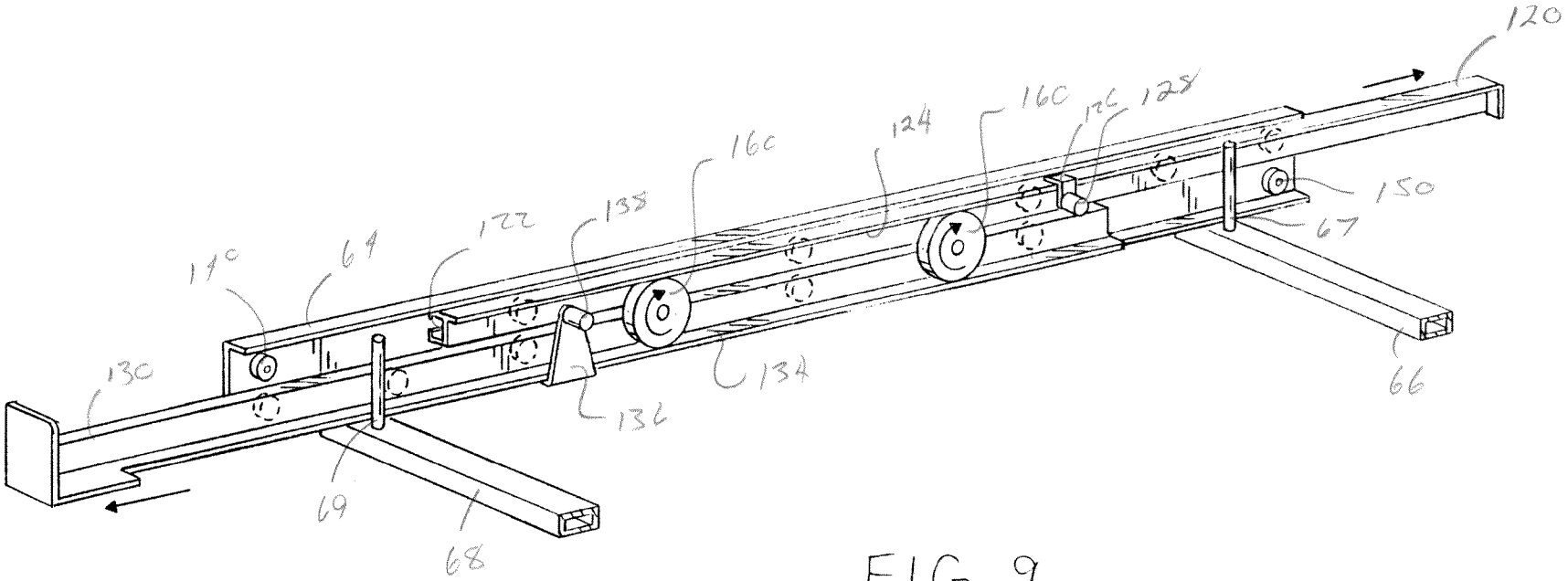
FIG. 9 is an assembled view of the rail system of FIG. 8.

Referring now to FIGS. 8-9, one non-limiting rail system that can be used to move the first and second top portions is illustrated. The rail system is designed to simultaneously move the first and second top portions. In such a configuration, a user need only pull/push one of first or second top portions to cause the other top portion to move. As can be appreciated, such a rail system is not required. The rail system is connected to each of the main side members 62, 64. The rail system includes a first rail 120 and a second rail 130. The first rail is connected to the first top portion and the second rail is connected to the second top portion. The first and second rails are generally connected to the bottom surface of the first and second top portions; however, the connection can be in other or additional locations. The arrangement used to connect the first and second top portions to the first and second rails is non-limiting (e.g., weld, bolts, screws, clamps, etc.). A mount flange 121, 131 is illustrated as being used to mount the first and second top portions to the first and second rails; however, this is not required. The first and second top portions are mounted to the rails such that the top surface of the first and second top portions lies in the same or generally the same plane. The first and second rails travel over a plurality of rollers 140, 150 that are mounted to the main side members 62, 64. As can be appreciated, an arrangement that fully or partially replaces the use of a roller can be used (e.g., slide arrangement, bearings, etc.). Each of the rails includes a C-shaped roller cavity 122, 132 that are designed to receive rollers 140, 150. The rail system also includes friction wheels 160 that are mounted to the main side members 62, 64. The friction wheels are used to cause the first and second rails to simultaneously move in opposite directions. The friction wheels also cause the first and second rails to move the same or substantially the same distance in opposite directions as illustrated by the arrows in FIG. 9. As can be appreciated, other arrangements can be used to cause the first and second rails to simultaneously move in opposite directions (e.g., chains, cables, rope, gears, rods, slat system, etc.). As illustrated in FIGS. 8 and 9, rails 120, 130 each include a wheel flange 124, 134 that is designed to engage the friction wheels. The material used to form the friction wheels is non-limiting. As illustrated in FIG. 9, when the first and second top portions are moved toward an expanded position, the friction wheels on main side member 64 rotate in a clockwise direction as illustrated by the arrows and thereby cause rails 120 and 130 to move in opposite directions to cause the first and second top portions to simultaneously move toward the fully expanded or extended position. When the first and second top portions are moved toward the fully non-expanded or non-extended position, the friction wheels on main side member 64 rotate in a counter clockwise direction and thereby cause rails 120 and 130 to move in opposite directions to cause the first and second top portions to simultaneously move toward one another. As can be appreciated, the rail system on main side member 62, not shown is a mirror configuration of the rail system on main side member 64 as described above. As can be appreciated, certain features on rail systems may not be present on the other rail system (e.g., friction wheels). As can be appreciated, the number of friction wheels and rollers on each of the rail systems is non-limiting.

Figure 10:
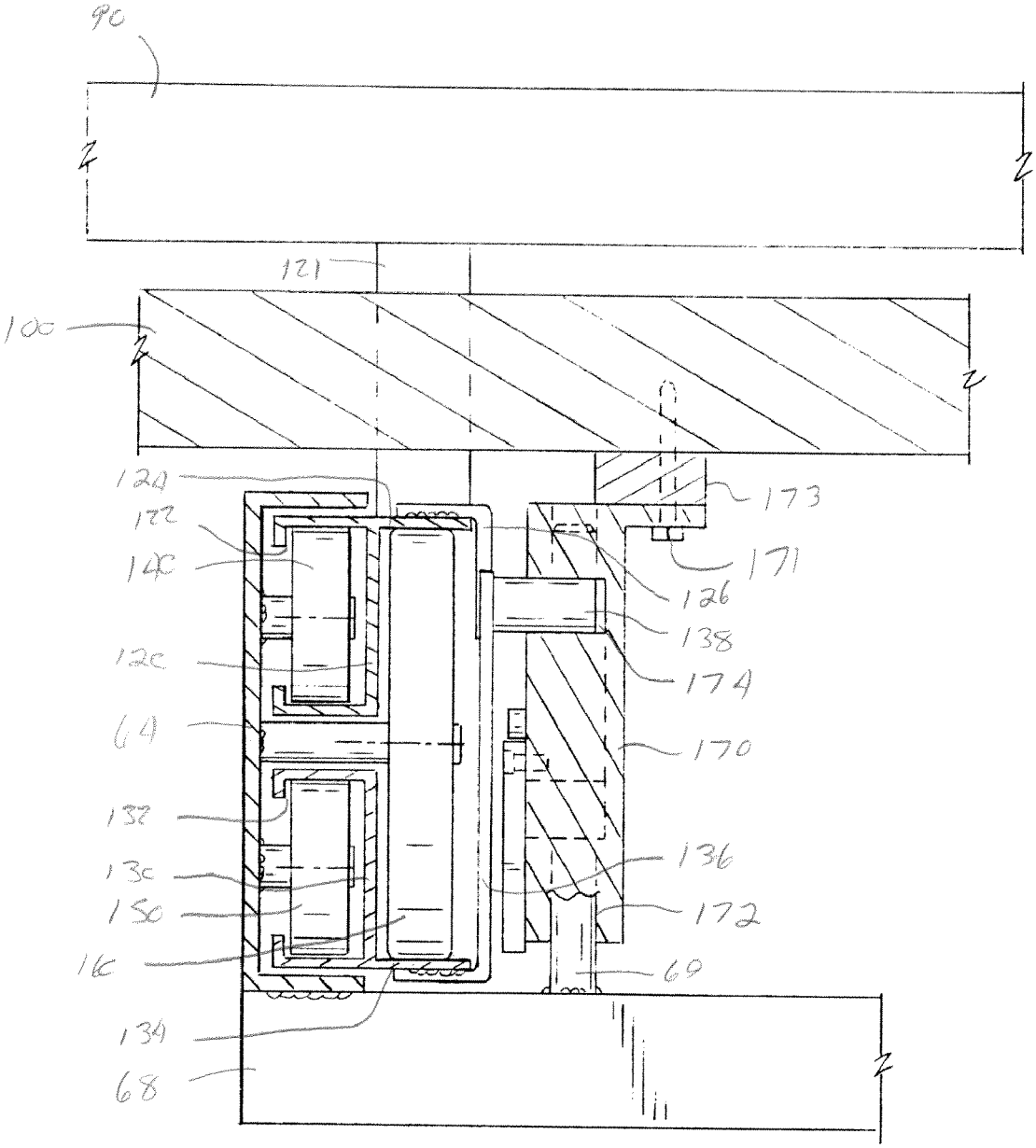
FIG. 10 is a cross-section view of a portion of the expandable table wherein the intermediate top portion is in the lower position.
Figure 11:
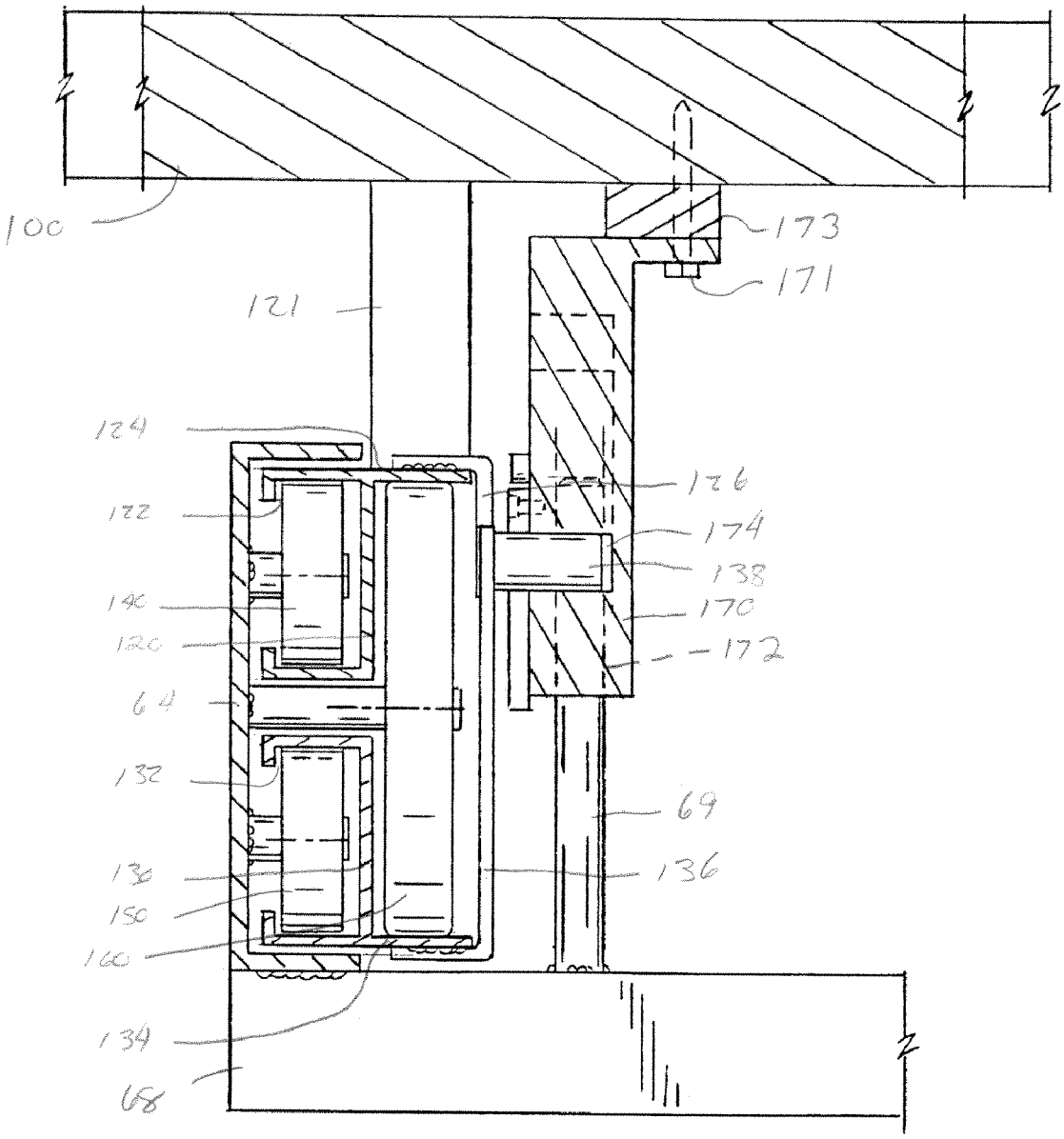
FIG. 11 is a cross-section view of a portion of the expandable table wherein the intermediate top portion is in the upper position.

Referring now to FIGS. 8-13, the non-limiting arrangement used to cause the intermediate top portion to move between the upper and lower positions is shown. The intermediate top portion is mounted to two rails 170, 180. The arrangement used to connect the intermediate top portion to the first and second rails is non-limiting (e.g., weld, bolts, screws, clamps, etc.). As illustrated in FIGS. 10 and 11, a screw 171 is used to secure the intermediate top portion to rail 172. An optional fastening grommet 173 can also be used. Each of the rails includes a guide pin opening 172, 182. The guide pin openings are designed to receive a guide pin 67, 69 that are connected to connector bars 66, 68. The guide pins are used to limit the movement of the intermediate top portion only to a plane normal to the movement of the first and second top portions. As can be appreciated, other arrangements can be used to limit the movement of the intermediate top portion only to a plane normal to the movement of the first and second top portions. Rails 170, 180 also include a slot arrangement 174, 184 that is used to cause the intermediate top portion to automatically move between the upper and lower positions when the first and second top portions are moved between the fully extended and unextended position. As can be appreciated, other arrangements can be used to cause the intermediate top portion to automatically move between the upper and lower positions when the first and second top portions are moved between the fully extended and unextended position (e.g., chain system, spring system, gear system, motor system, pulley system, etc.). As can also be appreciated, an arrangement can be used such that the intermediate top portion is manually moved between the upper and lower positions when the first and second top portions are moved between the fully extended and unextended position. In such an arrangement, there could be provided an upper retaining arrangement that maintains the intermediate portion in the upper position after being manually moved to the upper position so as to facilitate in moving the first and second top portions toward the raised intermediate portion to form the expanded configuration of the expandable table; however, this is not required. Rails 170, 180 can include other arrangements that can be used to cause the intermediate top portion to move between the upper and lower positions when the first and second top portions are moved between the fully extended and unextended position. The slot arrangement is designed to receive a guide post 126, 136 on rails 120, 130. The guide extension 128, 138 on the guide posts are oriented such that both of the guide extensions lie in the same plane that is substantially parallel to the plane of the top surface of the first and second top portions as illustrated in FIG. 9.

Referring now to FIGS. 10 and 11, a cross-sectional view of the rail system on main side member 64. FIG. 10 illustrates the top intermediate portion in the lower or stowed position. The positioning of guide extensions 128, 138 in the slot arrangement of rail 170 results in such positioning of the intermediate top portion. Guide pin 69 is positioned in guide pin opening 172 to limit the direction of movement of the intermediate top portion. FIG. 11 illustrates the top intermediate portion in the upper position. The positioning of guide extensions 128, 138 in the slot arrangement of rail 170 results in such positioning of the intermediate top portion. Guide pin 69 is maintained positioned in guide pin opening 172 to limit the direction of movement of the intermediate top portion. As can be appreciated, the guide pins can also be designed to limit the amount that the intermediate top portion can be raised; however, this is not required. As can also be appreciated, the configuration rail 180 can be the same as rail 170, and the operation can also be substantially the same as the intermediate top portion moving between the upper and lower position; however, this is not required.

Figure 12:
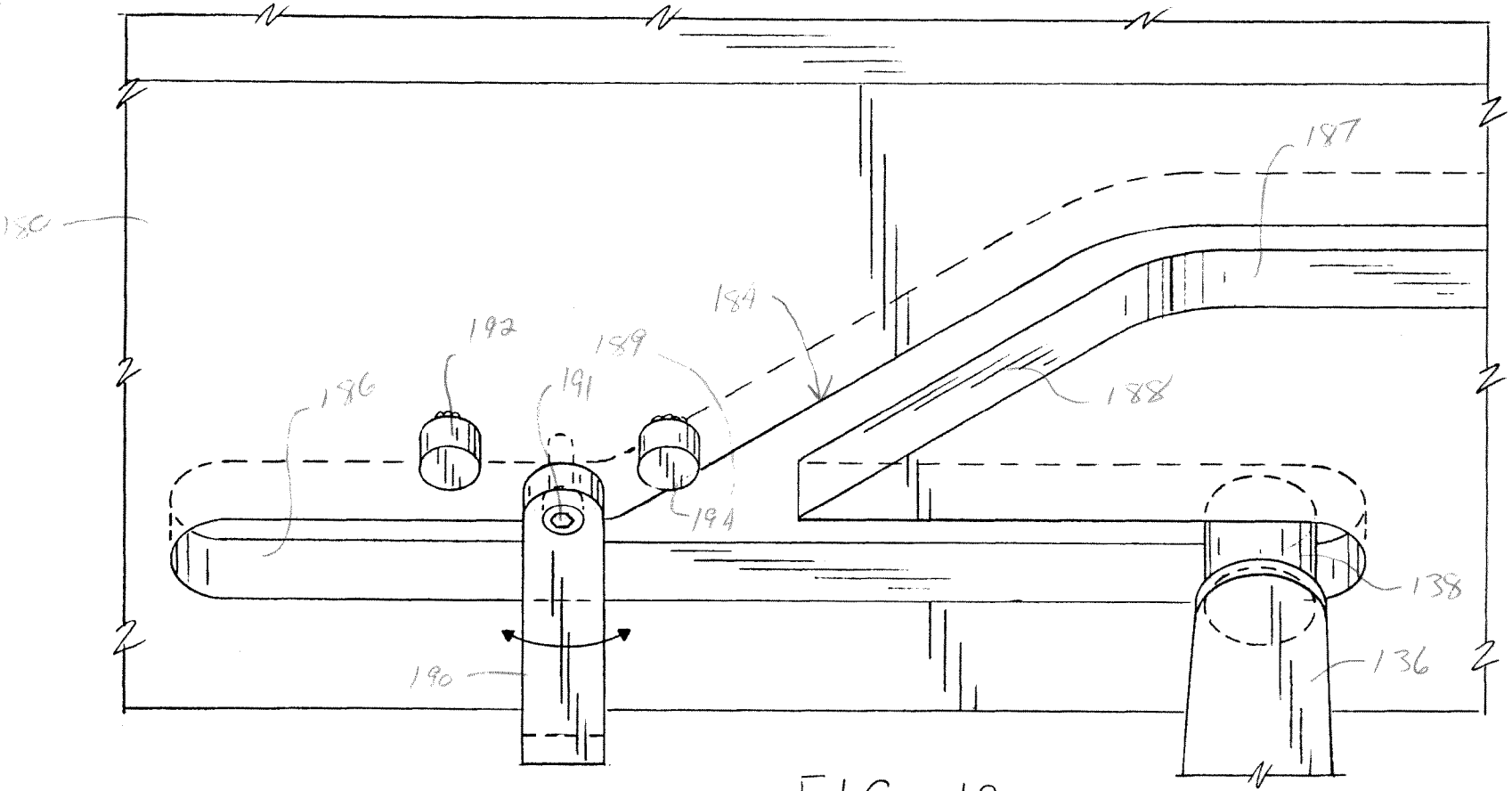
FIG. 12 is a sectional view of one non-limiting rail system configuration for the intermediate portion; and, FIGS. 13A-H illustrate the operation of the rail system configuration for the intermediate portion and how such rail system causes the intermediate portion to move between the upper and lower positions.

Referring now to FIG. 12, a sectional view of the slot arrangement 184 of rail 180 is illustrated. The slot arrangement includes a lower level 186, and upper level 187, a transition level 188, and a transition junction 189. As can be appreciated, a similar arrangement can exist on rail 170 as illustrated in FIG. 8. The rail also includes a gate flange 190 that is pivotally connected to rail 180. As illustrated in FIG. 12, a hex screw 191 is used to secure the gate flange to rail 180. As can be appreciated, the gate flange can be pivotally connected to rail 180 by other means. The arrows on the gate flange illustrate the direction the gate flange can pivot. The gate flange is generally mounted so that it hangs freely in the downward position by the force of gravity as illustrated in FIG. 12; however, this is not required. Pivot limiters 192, 194 are positioned on each side of the gate flange to limit the amount the gate flange can pivot in each direction. The positioning and the material used for the pivot limiters are non-limiting. The pivot limiters are generally positioned so that the gate flange can be sufficiently pivoted so that the guide extension 138 can move along the lower level of the slot arrangement.

Figure 13A:
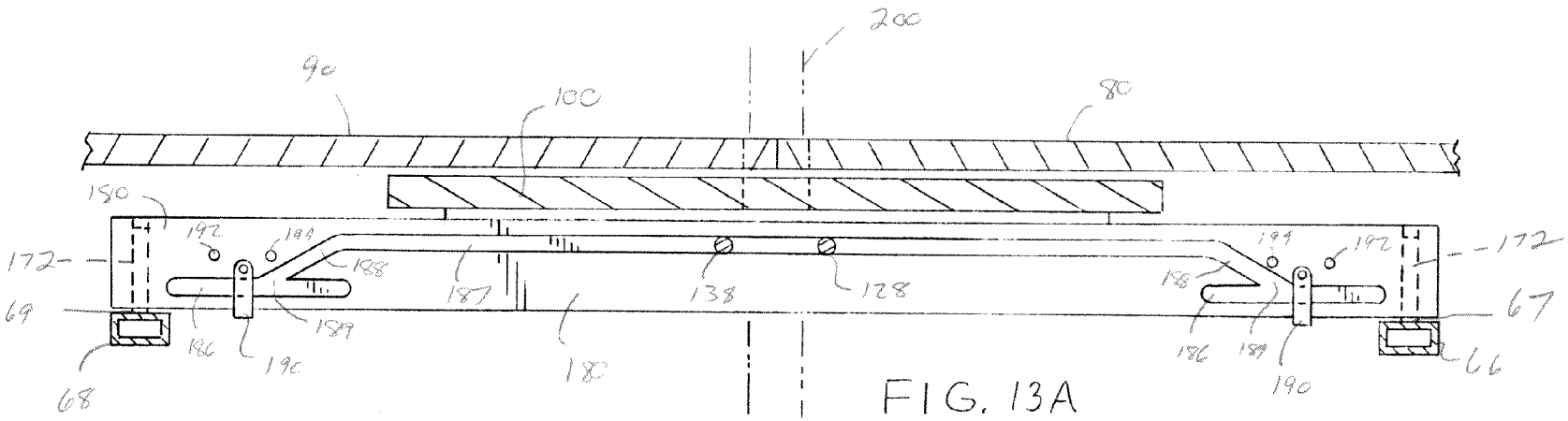
Figure 13B:
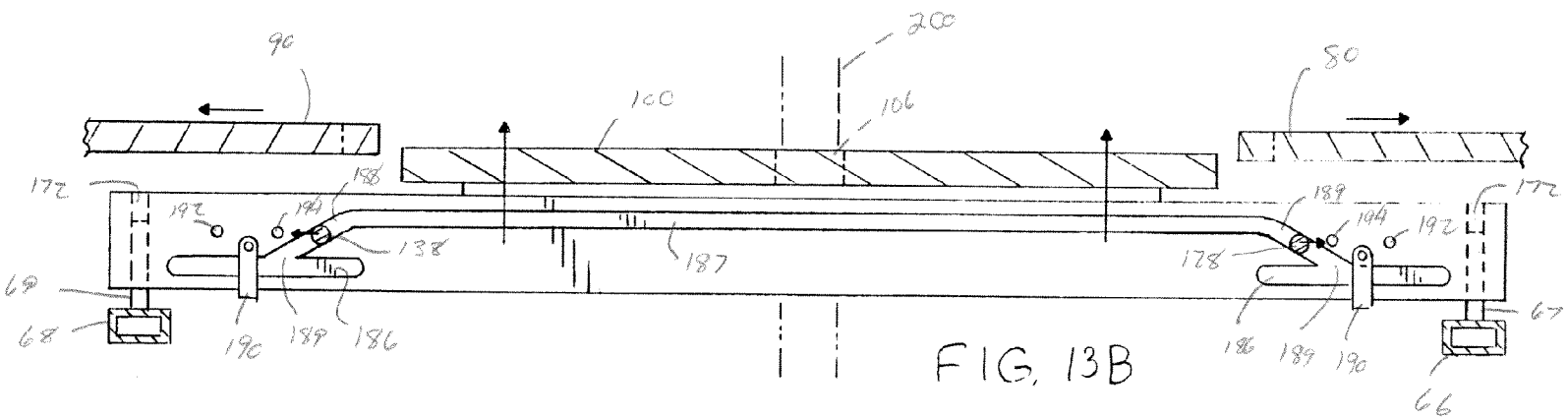
Figure 13C:
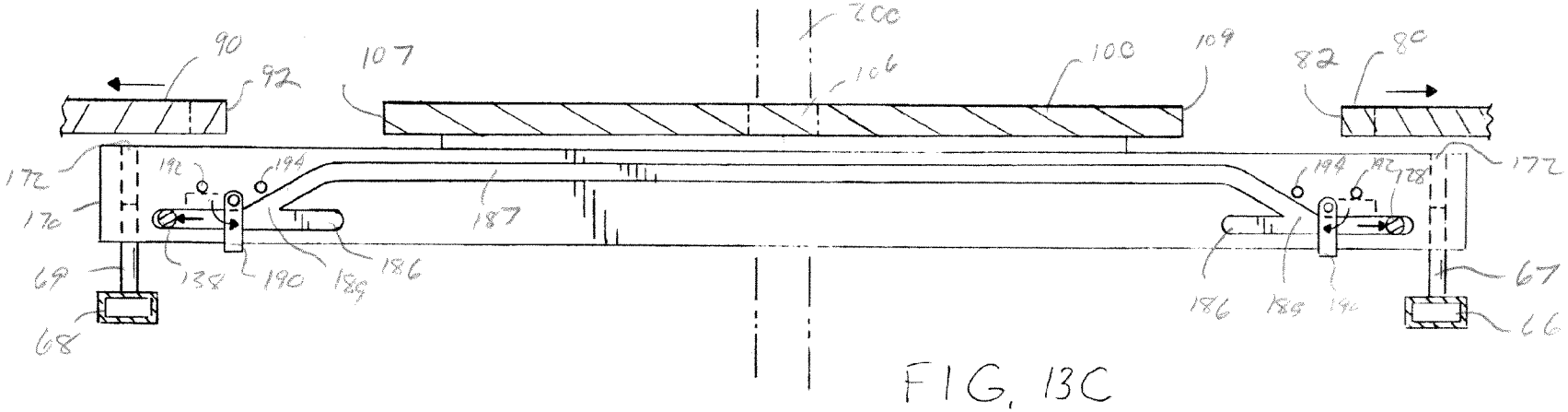
Figure 13D:
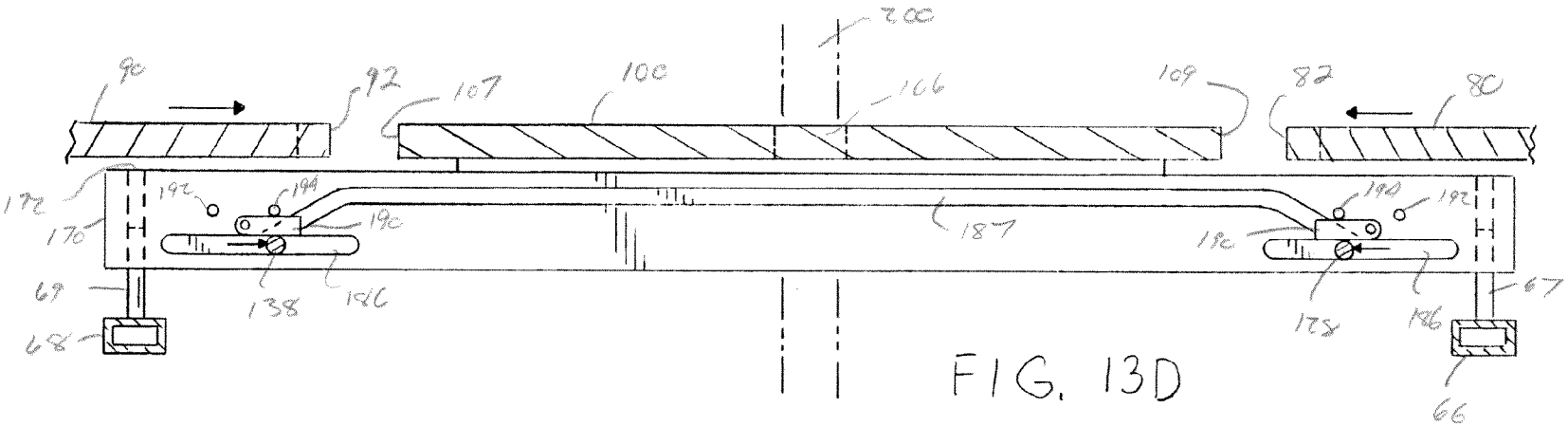
Figure 13E:
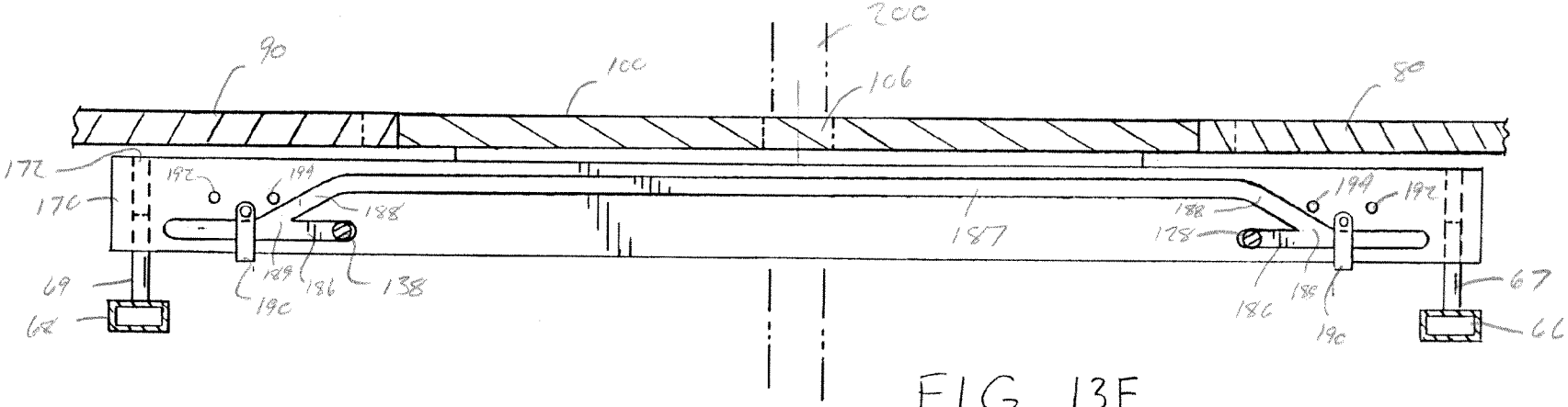

The movement of the guide extensions 128, 138 within the slot arrangement of rail 180 is illustrated in FIGS. 13A-H as the intermediate top portion 100 moves between the upper and lower positions as the first and second top portions are moved between the fully extended and fully unextended or collapsed positions. FIG. 13A illustrates the position of the intermediate top portion relative to the first and second top portions when the expandable table is in the unexpanded position. Guide extensions 128, 138 are positioned in the upper level 187 of the slot arrangement. FIG. 13B illustrates that the first and second top portions are moved away from one another as illustrated by the arrows. As guide extensions 128, 138 travels downwardly on the transition level 188 of the slot arrangement as illustrated by the arrows, the intermediate top portion is caused to begin moving upwardly as illustrated by the arrows. FIG. 13C illustrates the positioning of the first and second top portions in the fully extended or expanded position. The guide extensions 128, 138 in the lower level 186 of the slot arrangement limit further movement of the first and second top portions in the expanded direction once the guide extensions reach the end of the slot in lower level 186. The guide extensions 128, 138 have moved past the gate flanges 190 and the arrows on the gate flanges indicate the gate flanges are pivoting downwardly back to the rest position of the gate flange once the guide extensions have moved past the gate flange. Once the guide extensions 128, 138 have traveled to lower level 186 of the slot arrangement, the intermediate top portion is positioned in the fully upper position. When the first and second top portions are in the fully extended or expanded position, the inner side edges 82, 92 of the two top portions are spaced from the side edges 107, 109 of the intermediate top portion as illustrated in FIG. 13C. As can be appreciated, the first and second top portions do not need to be moved to the fully expanded or extended position to cause the intermediate top position to move to the full upper position and to reconfigure the expandable table into the expanded position. The expandable table is configured to the expanded position by moving the first and second top portions toward the top intermediate portion as illustrated in FIG. 13D as indicated by the arrows. As the guide extensions 128, 138 move horizontally along the lower level 186 of the slot arrangement, the guide extensions 128, 138 contact the gate flange 190 and cause the gate flange to pivot upwardly and to block the transition junction 189 so that the guide extensions 128, 138 can only proceed along the lower level of the slot arrangement. Pivot limiter 194 limits the upward movement of the gate flange, but allows the gate flange to pivot upwardly a sufficient distance to enable the guide extensions 128, 138 to pass under the gate flanges. FIG. 13E illustrates the expandable table in the final expanded position. The length of the lower level of the slot arrangement is selected to enable the first and second top portions to move toward the top intermediate portion so that the inner side edges 82, 92 of the two top portions contact or are positioned closely adjacent to side edges 107, 109 of the intermediate top portion. The gate flange is illustrated as hanging downwardly in the resting position. As illustrated in FIGS. 13A-13E, the intermediate top portion moved vertically upward or normal to the plane of movement of the first and second top portions. This novel movement of the intermediate top portion enables an umbrella, when used, to move in position relative to the expandable table as the expandable table is expanded and contracted.

Figure 13F:
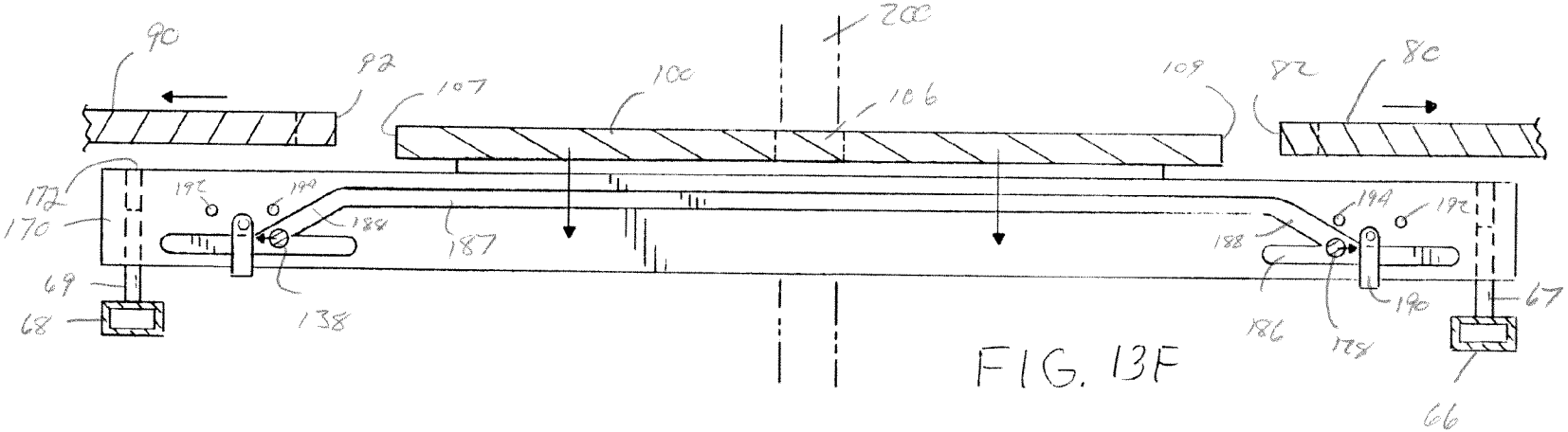
Figure 13G:
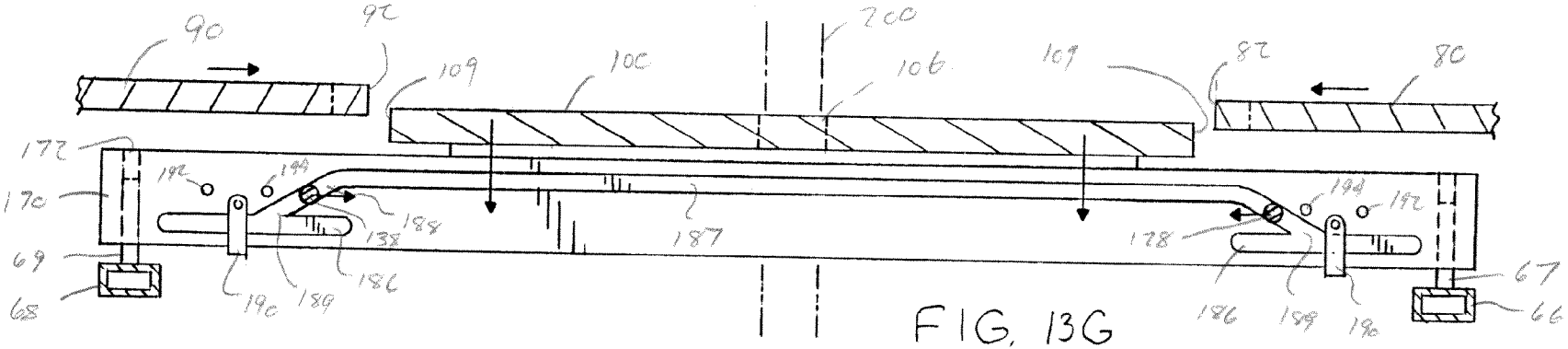
Figure 13H:
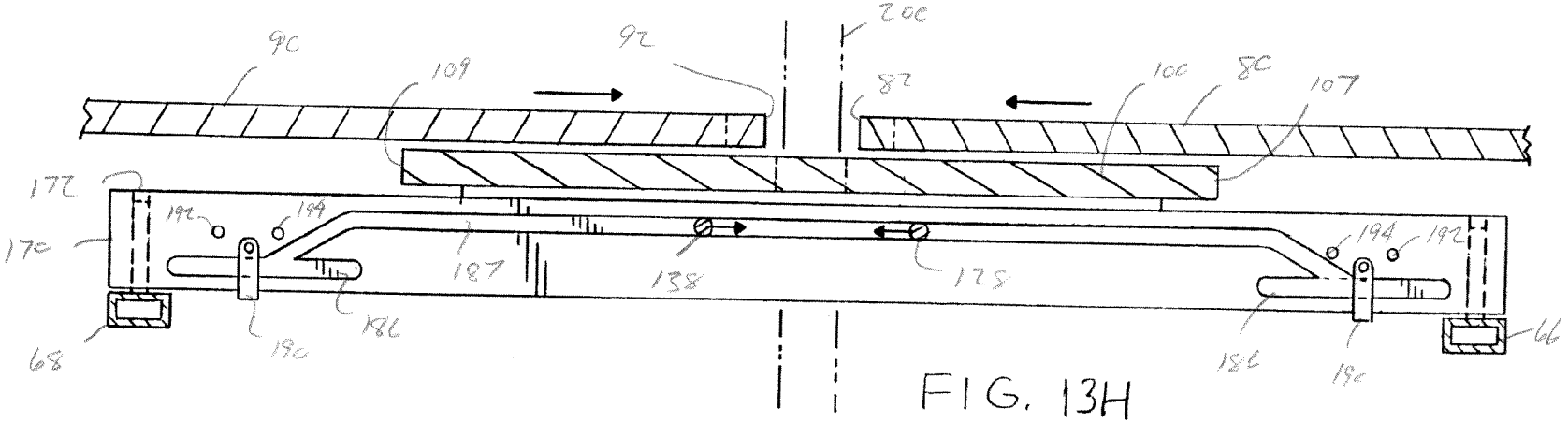

Referring now to FIGS. 13F-H, the reconfiguration of the expandable table from the expanded position to the unexpanded position is illustrated. The intermediate top portion is caused to move to the lower portion by initially moving the first and second top portions toward the fully extended or expanded position. Once the guide extensions 128, 138 reach the transition junction 189 in the slot arrangement, the guide extensions 128, 138 will move into transition level 188 since the weight of the intermediate top portion will cause the intermediate top portion to move toward the downward or stowed position as indicated by the arrows. Once the guide extensions 128, 138 move into transition level 188, the movement of the first and second top portions away from one another is stopped. As illustrated in FIG. 13F, the distance that the first and second top portions are spaced apart at the point that the guide extensions 128, 138 will move into transition level 188 is a smaller distance than when the first and second top portions are spaced apart when the intermediate top portion is being moved to the upper position as illustrated in FIG. 13C. As illustrated in FIGS. 13G and 13H, as the first and second top portions are moved together as indicated by the arrows, the guide extensions 128, 138 travel upwardly along the transition level 188 thereby causing the intermediate top portion to continue movement downwardly toward the lowered or stowed position. Once the guide extensions 128, 138 have reached the upper level 187 of the slot arrangement as illustrated in FIG. 13H, the intermediate top portion is positioned in the lowered or stowed position. The first and second top portions are continued to be moved together until positioned as illustrated in FIG. 13A which represents the unexpanded position of the expandable table.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

What is claimed:

1. An expandable table comprising a frame, at least one leg supporting said frame, first and second top portions movably connected or interconnected to said frame, an intermediate top portion movably connected or interconnected to said frame, and a movement mechanism connected or interconnected to said frame, said movement mechanism configured to cause said first and second top portions to move along a longitudinal axis of said frame between fully unexpanded and fully expanded positions, said movement mechanism configured to cause said intermediate top portion to move between an upper and lower position in a manner that is normal to said longitudinal axis of a plane of movement of said first and second top portions, said movement mechanism is configured to atomatically cause said intermediate top portion to move between a lower position and an upper position based on the orientation and movement of said first and second top portions along said longitudinal axis of said frame, said movement mechanism including a multi-level guide arrangement and a guide gate, said guide gate configured to move in a first position and a second position, said first position and second position of said guide gate controlling access to a particular level of said guide arrangement to enable upward or downward movement of said intermediate top portion, said multi-level guide arrangement including a first level, a second level, and a transition region connected to said first and second level, said first level is configured to cause said intermediate top portion to be positioned in said lower position, said second level is configured to cause said intermediate top portion to be positioned in said upper position, said transition region is configured to cause said intermediate top portion to move between said upper and lower positions, said intermediate top portion including guides that move in said first level, said second level, and said transition region when said intermediate top portion moves between said first and second levels as said first and second top portions move along said longitudinal axis of said frame between said fully unexpanded and said fully expanded positions, said guide gate controlling movement of said guides between said first level and said second level, said guides causing said guide gate to move between said first position and said second position, said intermediate top portion includes an opening designed to receive an umbrella pole, said movement mechanism configured to enable said intermediate top portion to move normal to said longitudinal axis of said plane of movement of said first and second top portions while at least a portion of the umbrella pole remains positioned within said opening of said intermediate top portion.

2. The expandable table as defined in claim 1, wherein at least one of said first and second top portions includes an umbrella recess that is configured to at least partially encircle an umbrella pole when said first and second top portions are positioned in said fully unexpanded positions.

3. The expandable table as defined in claim 2, including a movement limiter that limits movement of said intermediate top portion to movement in an axis that is normal to said axis of movement of said first and second top portions.

4. The expandable table as defined in claim 3, wherein said movement mechanism allows said first and second top portions to be separated a greater distance from one another when said intermediate top portion is being moved from said lower position to said upper position than when said intermediate top portion is being moved from said upper position to said lower position.

5. The expandable table as defined in claim 1, including a movement limiter that limits movement of said intermediate top portion to movement in an axis that is normal to said axis of movement of said first and second top portions.

6. The expandable table as defined in claim 1, wherein said movement mechanism allows said first and second top portions to be separated a greater distance from one another when said intermediate top portion is being moved from said lower position to said upper position than when said intermediate top portion is being moved from said upper position to said lower position.

7. A method for expanding and contracting an expandable table comprising the steps of:

a. providing an expandable table, said expandable table including a frame, at least one leg supporting said frame, first and second top portions movably connected or interconnected to said frame, an intermediate top portion movably connected or interconnected to said frame, and a movement mechanism connected or interconnected to said frame, b. providing a movement mechanism for moving said first and second top portions and said intermediate top portion, said movement mechanism configured to cause said first and second top portions to move along a longitudinal axis of said frame between fully unexpanded and fully expanded positions, said movement mechanism is configured to automatically cause said intermediate top portion to move between a lower position and an upper position based on the orientation and movement of said first and second top portions along said longitudinal axis of said frame, said movement mechanism including a multi-level guide arrangement and a guide gate, said guide gate configured to move in a first position and a second position, said first position and second position of said guide gate controlling access to a particular level of said guide arrangement to enable upward or downward movement of said intermediate top portion, said multilevel guide arrangement including a first level, a second level, and a transition region connected to said first and second level, said first level is configured to cause said intermediate top portion to be positioned in said lower position, said second level is configured to cause said intermediate top portion to be positioned in said upper position, said transition region is configured to cause said intermediate top portion to move between said upper and lower positions, said intermediate top portion including guides that move in said first level, said second level, and said transition region when said intermediate top portion moves between said first and second levels as said first and second top portions move along said longitudinal axis of said frame between said fully unexpanded and said fully expanded positions, said guide gate controlling movement of said guides between said first level and said second level, said guides causing said guide gate to move between said first position and said second position;

c. moving said first and second top portions away from one another along a longitudinal axis of said frame until a gap between said first and second top portions is greater than a width of said intermediate top portion;

d. causing said guides of said intermediate top portion to move from said first level to said second level of said multi-level guide arrangement to cause said intermediate portion to move from said lower position to said upper position after said gap between said first and second top portions is greater than a width of said intermediate top portion; and, e. moving said first and second top portions toward said top intermediate top portion until said inner side edges of said first and second top portions contact or are closely adjacent to outer side edges of said intermediate top portion.

8. The method as defined in claim 7, wherein said movement mechanism causes said intermediate top portion to move normal to said longitudinal axis of a plane of movement of said first and second top portions.

9. The method as defined in claim 8, wherein said movement mechanism causes said intermediate top portion to move from said upper position to said lower position after said first and second top portions are pulled apart from said intermediate top portion and subsequently pushed together, said guides on said intermediate top portion caused to move from said second level to said transition region and then to said first level as said first and second top portions are pushed together.

10. The method as defined in claim 9, wherein said intermediate top portion includes an opening designed to receive an umbrella pole, said movement mechanism configured to enable said intermediate top portion to move normal to said longitudinal axis of said plane of movement of said first and second top portions while at least a portion of the umbrella pole remains positioned within said opening of said intermediate top portion.

11. The method as defined in claim 10, wherein at least one of said first and second top portions includes an umbrella recess that is configured to at least partially encircle an umbrella pole when said first and second top portions are positioned in said fully unexpanded positions.

12. The method as defined in claim 7, wherein said movement mechanism causes said intermediate top portion to move from said upper position to said lower position after said first and second top portions are pulled apart from said intermediate top portion and subsequently pushed together, said guides on said intermediate top portion caused to moved from said second level to said transition region and then to said first level as said first and second top portions are pushed together.

13. The method as defined in claim 7, wherein said intermediate top portion includes an opening designed to receive an umbrella pole, said movement mechanism configured to enable said intermediate top portion to move normal to said longitudinal axis of said plane of movement of said first and second top portions while at least a portion of the umbrella pole remains positioned within said opening of said intermediate top portion.

14. The method as defined in claim 13, wherein at least one of said first and second top portions includes an umbrella recess that is configured to at least partially encircle an umbrella pole when said first and second top portions are positioned in said fully unexpanded positions.

* * * * *